US006679453B2

(12) United States Patent
Steiner

(10) Patent No.: US 6,679,453 B2
(45) Date of Patent: Jan. 20, 2004

(54) JETTISONABLE PROTECTIVE ELEMENT

(75) Inventor: Zeev Steiner, Haifa (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 09/988,337

(22) Filed: Nov. 19, 2001

(65) Prior Publication Data

US 2002/0059881 A1 May 23, 2002

(30) Foreign Application Priority Data

Nov. 23, 2000 (IL) ..... 139891

(51) Int. Cl.[7] ..... B64C 1/00
(52) U.S. Cl. ..... 244/121; 244/129.1
(58) Field of Search ..... 244/121, 122 A, 244/129.1, 149; 403/122, 126, 128

(56) References Cited

U.S. PATENT DOCUMENTS 3,721,407 A * 3/1973 Clarke ..... 244/121
3,786,757 A * 1/1974 Goldstein et al. ..... 102/213
3,970,006 A * 7/1976 Copeland et al. ..... 89/1.14
4,291,848 A * 9/1981 Clark ..... 244/3.16
4,721,272 A * 1/1988 Nordhaus ..... 244/122 AF
4,860,968 A * 8/1989 Pinson ..... 244/3.12
4,867,357 A * 9/1989 Inglis et al. ..... 244/121
5,036,770 A * 8/1991 Llewellin et al. ..... 102/293
5,167,386 A * 12/1992 Laquer et al. ..... 244/158 R
5,205,516 A * 4/1993 Bright et al. ..... 244/121
5,743,492 A * 4/1998 Chan et al. ..... 244/118.2
5,820,077 A * 10/1998 Sutliff et al. ..... 244/119
5,954,296 A * 9/1999 Jahsman et al. ..... 244/121

OTHER PUBLICATIONS

D Harris: "Materials for Infrared Windows and Domes" (SPIE Optical Engineering Press 1948 pp195–214).
Kohin et al: "Design of transparent conductive coatings and filters" SPIE Crit. Rev. CR39: 3–34 (1992).
Pellicori and Colton "Fluoride compounds for IR Coatings" Thin Solid Films 209: 109–115 (1992).
Rudisill et al: "Optical Coatings for high energy Znse Laser Windows" Appl. Opt. 13 2075–2080 (1974).
Bui and Hassan "Highly durable conductive coating for visible and NIR applications" (Proc SPIE 3060:2–10 (1997).

* cited by examiner

*Primary Examiner*—Michael J. Carone
*Assistant Examiner*—Daniel Matz
(74) *Attorney, Agent, or Firm*—Mark M. Friedman

(57) ABSTRACT

An airborne platform comprising: (a) an aerodynamic body; (b) a protected element within the aerodynamic body; and (c) a cover, reversibly secured to the aerodynamic body, for protecting the protected element from an external atmosphere. The present invention is particularly suited for an electro-optical detection system equipped with an optical dome or window. Optical windows carried on airborne platforms are known to be particularly sensitive to the high temperatures generated by air friction at super-sonic speeds. By covering such a window when the airborne platform is in flight, and releasing the cover just before use, the electro-optical detection system equipped with the optical window can be made operative, even at airborne platform speeds of several Mach and higher.

22 Claims, 6 Drawing Sheets

JETTISONABLE PROTECTIVE ELEMENT

FIELD AND BACKGROUND OF THE INVENTION

The present invention relates to a jettisonable element and a high speed missile utilizing same. More particularly, the present invention relates to a high speed missile including at least one jettisonable element that functions as a detachable cover protecting an optical window or dome from the external atmosphere, as a drag reduction element, and/or as a radar ghost when jettisoned.

The navigation of a missile to target is achieved using a guidance system. One or more guidance systems are generally employed. Radar is one such guidance system. Although radar is effective, it is subject to interference, both intentional interference deployed as a defense mechanism, and accidental interference resulting from environmental conditions. Therefore, radar is often employed in conjunction with optical or electro-optical guidance systems, either of which may operate in the visible or infrared portion of the spectrum. These guidance systems are composed of a sensor or a detection system (e.g., electro-optical camera), and an analyzing system. The detection system must be onboard, although the analyzing system may be located outside the missile, for example at a base on the ground or in a platform such as an airplane which launched the missile, which communicates with the missile during flight. Alternatively, both the detection system and the analyzing system are carried on-board. This alternative, referred to as a "launch and forget" guidance system, is especially desirable in the case of missiles flying at high supersonic speeds where the time available for navigation decisions is extremely short, making communication with a remote location a practical impossibility.

The detection system must have a sensor in communication with the environment. At the same time, the sensor must be protected from the environment. For optical or electro-optical guidance systems this protection typically takes the form of an optical window or dome. These windows or domes are transparent to transmissions in a chosen range of wavelengths, while being opaque to transmissions with a wavelength outside that range. These optical windows or domes are typically coated with a shielding material which gives the window or dome the desired optical properties. As explained by D. Harris in "Materials for Infrared Windows and Domes" (SPIE Optical Engineering Press, 1948), which is incorporated herein by reference, most common approaches to shielding include coating the optical window with an electrically conductive layer, covering the window with a metallic mesh, or increasing the conductivity of the material forming the window. In general, the thin electrically conductive coatings applied to the window are transparent at visible and/or infrared frequencies, but opaque to microwaves and radio waves. This makes such coatings useful in shielding sensitive electro-optical detectors against harmful electromagnetic interference (Kohin et al., SPIE Crit. Rev. CR 39:3–34(1992)). The shielding capabilities of these materials stems from their ability to reflect and/or absorb incident radiation. In general, the greater the conductivity of the coating material, the more effective the shielding. Common coating materials are described in, for example, (i) Pellicori and Colton (Thin Solid Films 209:109–115(1992)); (ii) Rudisill et al. (Appl. Opt. 13:2075–2080 (1974)), and (iii) Bui and Hassan (Proc. SPIE 3060:2–10(1997)), all of which are incorporated herein by reference. Since the conductivity of these materials decreases with increasing temperature, they lose their shielding effectiveness when they are heated. At the same time, transmission of desired wavelengths through the shield is often diminished by heating.

The use of missiles that include electro-optical detection systems is often constrained to near-sonic speeds, because at very high speeds (e.g., above several Mach), friction from the air causes heating of the optical window or dome which protects the electro-optical detection system. This heating changes the conductivity of the coating on the optical window or dome and as such alters the optical properties thereof. This results in incapacitation of the detection system of the missile, either because transmissions in the chosen range of wavelengths no longer pass through the window or dome, or because interference (transmissions with a wavelength outside the chosen range) is allowed to pass through the window or dome.

Consequently, prior art missiles flying at high speeds are substantially limited to radar guidance systems.

There is thus a widely recognized need for, and it would be highly advantageous to have, a cover for protecting an optical window or dome of missiles (and airborne platforms in general) from an external environment, which cover can be jettisoned to allow target acquisition by the optical payload when necessary. It would be of further advantage if the cover would also serve to reduce drag. Such a cover can also serve as a radar reflecting element, and as such produce a radar ghost when jettisoned.

SUMMARY OF THE INVENTION

According to the teachings of the present invention there is provided an airborne platform comprising: (a) an aerodynamic body; (b) a protected element within the aerodynamic body; and (c) a cover, reversibly secured to the aerodynamic body, for protecting the protected element from an external atmosphere.

According to another aspect of the present invention there is provided an airborne platform comprising: (a) an aerodynamic body; (b) an electro-optical detection system situated within the aerodynamic body, the electro-optical detection system being equipped with an optical window; and (c) a cover, reversibly secured to the aerodynamic body, for protecting the optical window from an external atmosphere.

According to further features in the described preferred embodiments, the airborne platform further includes: (d) a mechanism for at least partially detaching the cover from the aerodynamic body.

According to still further features in the described preferred embodiments, the airborne platform further includes: (e) a securing assembly for securing the cover to the aerodynamic body.

According to still further features in the described preferred embodiments, the cover is breakable, such that the releasing mechanism breaks the releasable element, thereby releasing the cover.

According to still further features in the described preferred embodiments, the releasing mechanism is operative to first act against the releasable element to unsecure the second end of the cover, and only subsequently to act against aerodynamic force, thereby detaching the second end of the cover from the aerodynamic body.

According to still further features in the described preferred embodiments, the securing assembly includes a hinge reversibly connecting a first end of the cover to a first region of the aerodynamic body, and a releasable element securing a second end of the cover to a second region of the aerodynamic body.

According to still further features in the described preferred embodiments, the hinge is configured such that when the second end of the cover separates from the second region of the aerodynamic body when the airborne platform is in flight, an aerodynamic force exerted by the external atmosphere on the cover detaches the hinge, thereby removing the cover from the aerodynamic body.

According to still further features in the described preferred embodiments, the hinge includes a stoppage element, the stoppage element serving for limiting an angular movement of the hinge such that when the second end of the cover separates from the second region according to a predetermined parameter, the force exerted on the cover breaks the cover in a predetermined location.

As used herein and in the claims section that follows, the term "predetermined parameter" refers to a particular angle of rotation or a particular distance at which the cover and hinge structure is designed and made operative to detach the cover. In many hinges, the requisite separation of the cover from the second region for triggering the detachment of the cover can be defined either as an angle or as a distance (or some combination thereof).

According to still further features in the described preferred embodiments, the hinge includes an asymmetric ball element disposed in a socket. Thus, when the second end of the cover separates from the second region by a predetermined angle, the asymmetric ball element is rotated until disengagement from the socket, effecting spontaneous disassembly of the ball element.

According to still further features in the described preferred embodiments, this force includes an aerodynamic force exerted on the cover by the external atmosphere. According to still further features in the described preferred embodiments, this force includes a force delivered to the cover by the releasing mechanism.

According to still further features in the described preferred embodiments, the hinge includes a shearable pin.

According to still further features in the described preferred embodiments, the cover is operative to jettison away from the platform when released.

According to still further features in the described preferred embodiments, the cover includes at least one radar reflective region, such that the jettisoning of the cover from the airborne platform generates a radar ghost.

According to another aspect of the present invention there is provided a device for protecting an element in an airborne platform from an external atmosphere, the device comprising: (a) a cover, reversibly secured to an aerodynamic body of the airborne platform, for protecting the protected element from an external atmosphere; and (b) a mechanism for at least partially detaching the cover from the aerodynamic body.

According to further features in the described preferred embodiments, the cover is operative to jettison away from the platform when released.

According to still further features in the described preferred embodiments, the cover includes at least one radar reflective region, such that the jettisoning of the cover from the airborne platform generates a radar ghost.

According to still further features in the described preferred embodiments, the securing assembly includes a hinge for connecting a first end of the cover to a first region of the aerodynamic body, and a releasable element securing a second end of the cover to a second region of the aerodynamic body.

According to still further features in the described preferred embodiments, the device further includes: (e) a securing assembly for securing the cover to the aerodynamic body.

According to still further features in the described preferred embodiments, the releasing mechanism includes a high pressure gas reservoir as a source of energy for a force acting upon the releasable element.

According to still further features in the described preferred embodiments, the releasing mechanism includes a pyroelectric element as a source of energy for a a force acting upon the releasable element.

According to still further features in the described preferred embodiments, the releasing mechanism is designed to first act against the releasable element to unsecure the second end of the cover, and only subsequently to act against the aerodynamic force, thereby detaching the second end of the cover from the aerodynamic body.

According to another aspect of the present invention there is provided a method of protecting an element in an airborne platform, the airborne platform having an aerodynamic body, from an external atmosphere, the method comprising: (a) covering the element with a cover to the aerodynamic body; (b) securing the cover to the aerodynamic body; and (c) releasing and at least partially detaching the cover to expose the element.

According to further features in the described preferred embodiments, the securing of the cover is achieved using a hinge for connecting a first end of the cover to a first region of the aerodynamic body, and a releasable element for securing a second end of the cover to a second region of the aerodynamic body.

According to still further features in the described preferred embodiments, the releasable element is broken, thereby releasing the cover.

According to still further features in the described preferred embodiments, the releasing of the cover and the at least partially detaching the cover are performed by a releasing mechanism in discrete, sequential stages.

According to still further features in the described preferred embodiments, the releasing of the cover is performed in a first stage and the at least partially detaching of the cover is performed subsequently in a second stage, such that the releasing mechanism acts against aerodynamic force only in the second stage.

The present invention successfully addresses the shortcomings of the existing technologies by providing a system for and method of protecting airborne elements such as optical domes and windows from the air friction and the high temperatures generated while flying at high speed.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
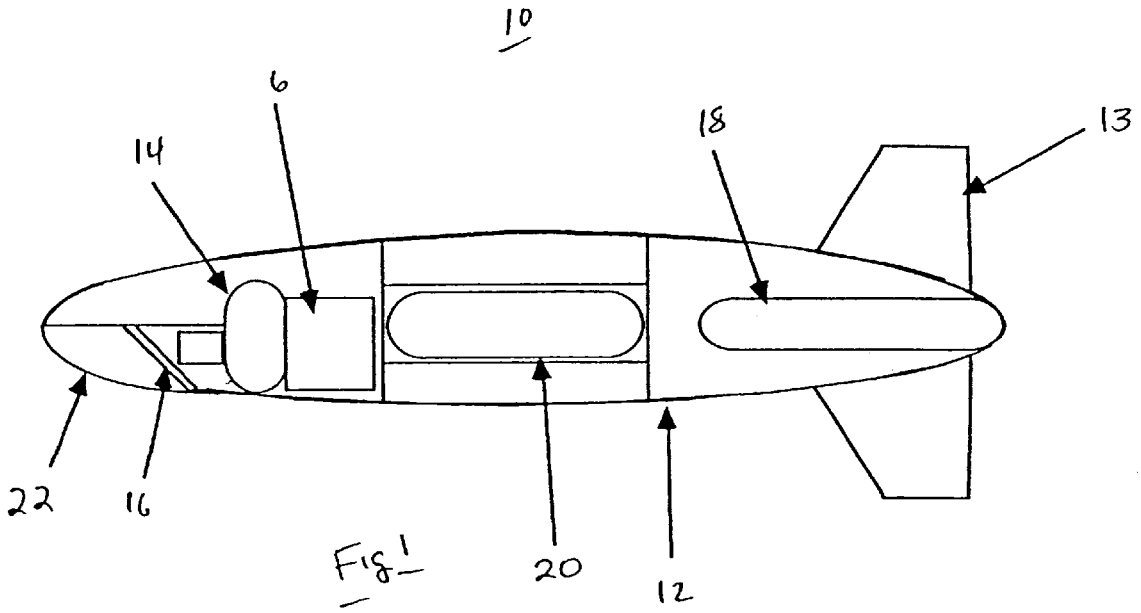
FIG. 1 is a partly cross sectional partly side view of a missile including the jettisonable electro-optical window or dome cover according to the teachings of the present invention.

The present invention is of a jettisonable element which can be utilized as a cover for protecting an optical window or dome of a missile from the external atmosphere and/or as a radar ghost when jettisoned. Specifically, the present invention is of an element which can be utilized to shield an optical window or dome of a high speed missile from the external atmosphere when attached, and/or to generate a radar ghost when jettisoned. According to the present invention, this element is detachably attached to a missile body via a securing assembly which enables jettisoning of the element from the missile when the missile is in flight.

The principles and operation of the present invention may be better understood with reference to the drawings and accompanying descriptions.

Before explaining at least one embodiment of the invention in detail, it is to be understood that the invention is not limited in its application to details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

The use of missiles that include electro-optical detection systems is often constrained to near-sonic speeds, because at very high speeds (e.g., above several Mach), friction from the air causes heating of the optical window or dome which protects the electro-optical detection system. This heating changes the conductivity of the coating on the optical window or dome and as such alters the optical properties thereof. This results in incapacitation of the detection system of the missile, either because necessary data (transmissions in the chosen range of wavelengths) no longer passes through the window or dome, and/or because interference data (transmissions with a wavelength outside the chosen range) is allowed to pass through the window or dome.

Since electro-optical detection systems are typically utilized by missiles during final target acquisition stages, such systems are only deployed during the final stages of trajectory. Thus, as is further described herein, the present invention provides a jettisonable heat shield which is utilized in high speed missiles for shielding the optical window or dome from heat when the missile is in flight. This heat shield is provided with a releasable securing assembly such that during the final stages of trajectory the heat shield can be jettisoned to expose the optical window or dome to the external atmosphere such that target acquisition can be effected by the electro-optical detection system.

As used herein and in the claims section which follows, the term "optical window" is a general term that also includes any type of optical dome.

More generally, an optical window is one example of a protected element that may be housed within an airborne platform.

As used herein and in the claims section which follows, the terms "airborne platform" and "missile" are used interchangeably to refer to any airborne vessel or projectile, including, but not limited to a launchable projectile carrying an explosive charge. Also included in the definition are self-propelled missiles and missiles which move primarily due to an initial force applied at launch. Further included in the definition are airplanes and the like (e.g., a pod suspended from the wing of an aircraft), particularly those flying at high speeds.

Referring now to the drawings, FIG. 1 illustrates a missile capable of operating at high speeds, which is referred to herein as missile 10.

Missile 10 includes an aerodynamic body 12 which is provided with at least one flight control mechanism 13, such as at least one flight control surface (fin), which serves for stabilizing missile 10 and directing it to a target.

Aerodynamic body 12 serves for housing an electro-optical detection system 14 equipped with an optical window or dome 16. Preferably, optical window or dome 16 is coated with an optical coating which is substantially transparent to radiation at the visible and/or the infrared portion of the electromagnetic spectrum and substantially opaque to radiation at the radio frequency and/or radar frequency portion of the electromagnetic spectrum.

The optical coating is characterized by high conductivity. Examples of suitable optical coating include, but are not limited to, doped Gallium Arsenide coat and doped Germanium coat.

Electro-optical detection system 14 typically includes one or more sensors, such as a Forward Looking Infrared (FLIR) or video camera, or any other focusing component provided with an array of photosensitive elements, e.g., a charge coupled device (CCD). The focusing component may include, for example, lenses, reflectors, beam splitters, mirrors, and prisms arranged or configured to direct and focus incident radiation to the array of photosensitive elements. Electro-optical detection system 14 may also include various electronic systems which control the sensors, analyze and interpret the signals received by the sensors, and control the final trajectory of missile 10 by maneuvering flight control mechanism 13. Electro-optical detection system may also include means for receiving signals from outside of the missile and may also include means for transmitting signals from the missile. Such electro-optical guidance systems are well known in the art and as such no further description is given herein.

Aerodynamic body 12 preferably also houses a guidance system 6 which serves to control flight path of missile 10 before approaching a final trajectory. Such guidance systems operate according to well known principles and typically utilize such technologies such as, but not limited to, radar guidance or satellite (GPS) guidance. Preferably, aerodynamic body 12 further includes a liquid or solid fuel propulsion system 18 which serves to propel missile 10 to high speeds. Such propulsion systems are well known in the art and as such, no further description is provided herein.

Aerodynamic body 12 also includes a warhead 20, which is designed to detonate prior to, during, or following impact of missile on target. Missile 10 further includes a cover 22 which is secured to aerodynamic body by a releasable securing assembly which is further described hereinbelow. According to this aspect of the present invention cover 22 is positioned and configured so as to cover and protect optical window or dome 16 from an external atmosphere. Thus, when the missile is operating at high speeds, cover 22 serves as a heat shield. The releasable securing assembly is configured so as to allow cover 22 to be controllably jettisoned from missile 10 when in flight, to thereby expose optical window or dome 16 to external atmosphere when approaching a target.

Figure 2:
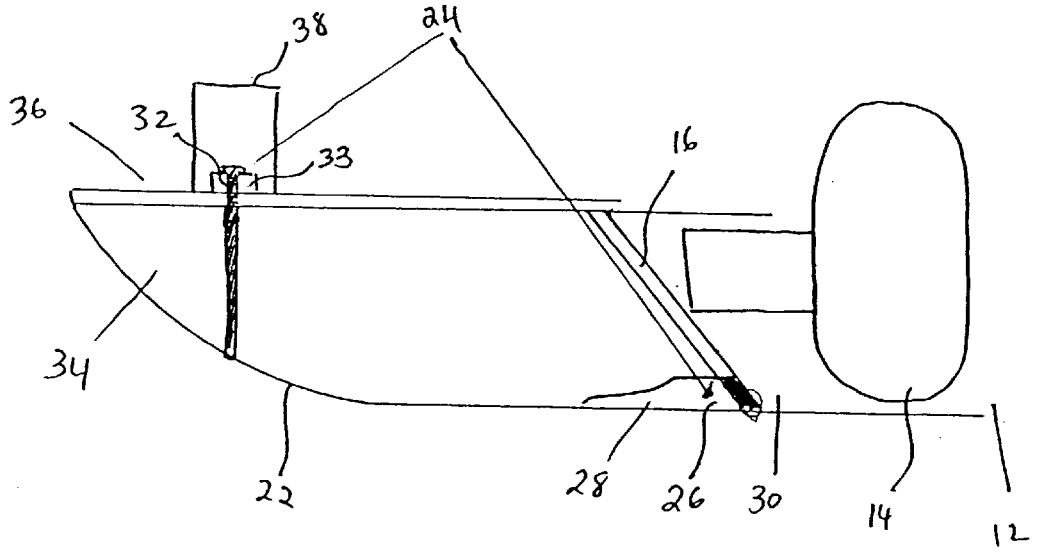
FIG. 2 is a close up view of the cover region depicted in FIG. 1, showing the releasable securing assembly and releasing mechanism according to the present invention.

According to another preferred embodiment of the present invention and as shown in FIG. 2, cover 22 is secured to aerodynamic body 12 via a releasable securing assembly 24. Preferably, assembly 24 includes a hinge 26 for hingedly connecting a first end 28 of cover 22 to a first region 30 of aerodynamic body 12. Hinge 26 can be any one of several types disclosed herein, but it will be appreciated that other types of hinges may be implemented by those skilled in the art. Assembly 24 also includes a securing element 32 for releasably securing a second end 34 of cover to a second region 36 of aerodynamic body 12.

As is further described hereinbelow, aerodynamic body further includes a releasing mechanism 38 for controllably unsecuring element 32.

As used herein and in the claims section which follows, the term "hinge" refers to a rotatable element. Various types of hinges are mentioned explicitly herein by way of example.

The terms "release" and "unsecure" are interchangeably used herein to refer to the action of unlocking but not separating two or more components, whereas the terms "detach" and "separate" are used interchangeably to refer to physically separating, i.e., putting a distance between two or more components.

According to another preferred embodiment of the present invention securing element 32 is a bolt. Bolt 32 preferably includes a threaded region which threads into a breakable element 33 attached to second region 36 of aerodynamic body 12 as is further described hereinbelow. It will be appreciated that although securing element 32 is exemplified herein as a bolt, it can be of any design capable of securing second end 34 of cover 22 to second region 36 of aerodynamic body 12.

Figure 5:
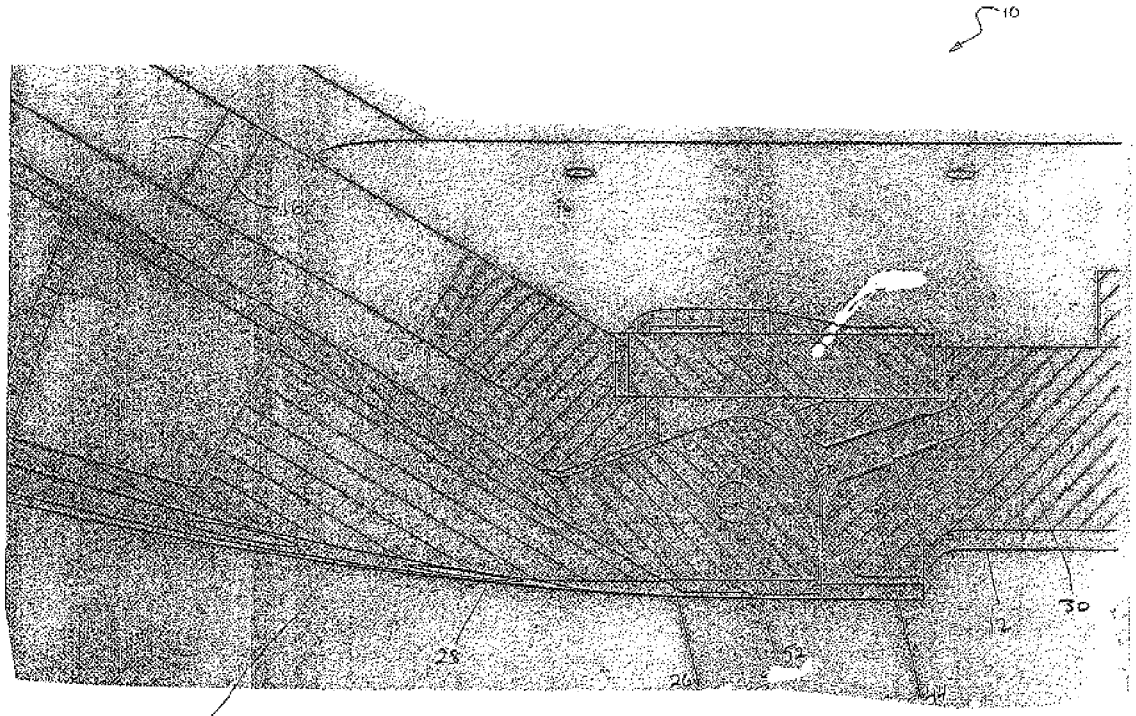
FIG. 5 is a cross sectional view of one embodiment of a shearable pin according to the present invention.

In a preferred embodiment, bolt 32, instead of being threaded into breakable element 33, is secured to second region 36 by a shearable pin (an example of a shearable pin 52 is provided in FIG. 5).

Figure 3:
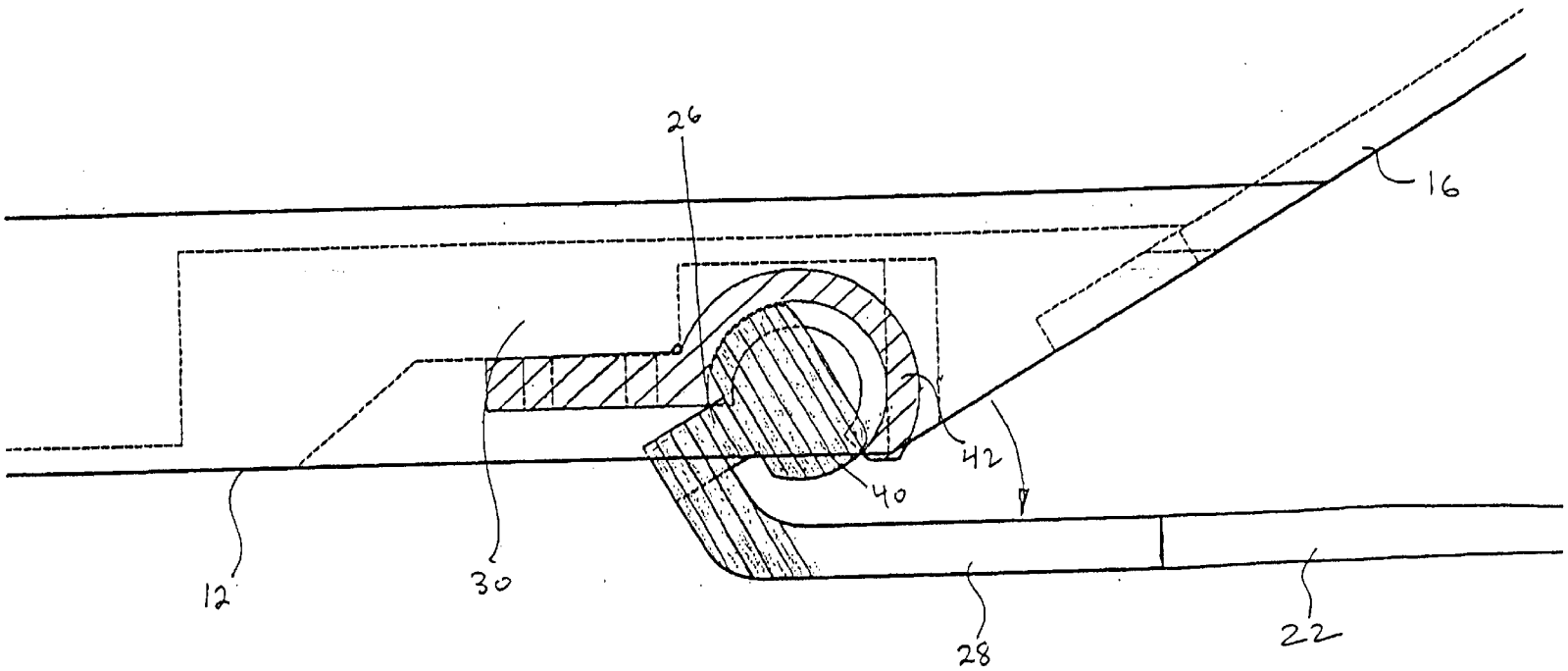
FIG. 3 is a cross sectional view of one embodiment of a releasable hinge according to the present invention.

According to another preferred embodiment of the present invention, and as specifically shown in FIG. 3, hinge 26 is configured such that first end 28 of cover 22 detaches from first region 30 when second end 34 of cover 22 separates a predetermined distance from second region 36 of aerodynamic body 12 when missile 10 is in flight. To enable such detachment, hinge 26 can be of an asymmetric ball in socket configuration, by way of example. According to this configuration, when second end 34 of cover 22 separates from second region 36 of aerodynamic body 12 by a predetermined angle, ball element 40 moves in socket element 42 to a point where ball element 40 frees from socket 42, thus enabling spontaneous disassembly of hinge 26 (i.e., ball element 40 falls out of socket element 42) and subsequent detachment of first end 28 of cover 22 from first region 30 when missile 10 is in flight.

According to another preferred embodiment of the present invention, hinge 26 is a breakable hinge. According to this configuration, when second end 34 of cover 22 rotatably separates from second region 36 by a predetermined angle, a force exerted on cover 22 breaks hinge 26 at a structurally weakened region formed in hinge 26. This force may be primarily an aerodynamic force applied by the external atmosphere when missile 10 is in flight, particularly at high speeds. Alternatively or additionally, the force may be delivered to cover 22 by releasing mechanism 38 (see FIGS. 2, 6).

To force hinge 26 to break, region 30 of aerodynamic body 12 includes a stoppage element 44 which serves for limiting an angular movement of hinge 26. Thus, when second end 34 of cover 22 separates from second region 36 a predetermined distance, hinge rotates to a stop against stoppage element 44, following which, the aerodynamic force exerted by the external atmosphere on cover 22 when missile 10 is in flight, breaks hinge 26 at a designed weakened region thereof.

Figures 4A, 4B, 4C, 4D, 4E:
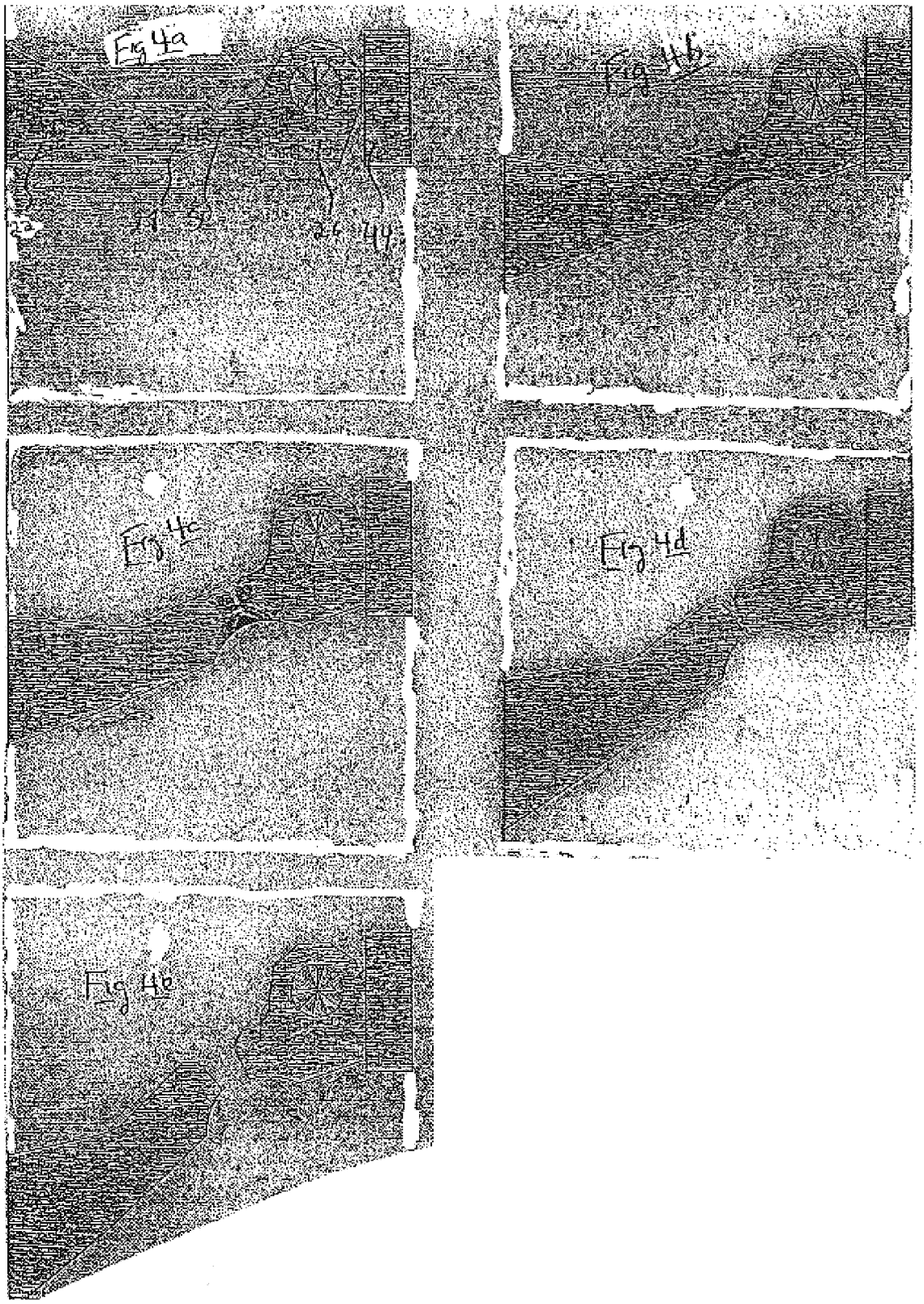
FIGS. 4*a–e* are cross sectional views of another embodiment of a breakable hinge according to sequence of events leading to hinge breakage.

According to another preferred embodiment of the present invention, and as specifically shown in FIGS. 4*a-c* the weakened region 50 is a region interconnecting hinge 26 to cover 22. Region 50 can be structurally weakened by an introduction of a groove or by the use of structurally weaker material as compared to the material utilized to fabricate the regions of hinge 26 and cover 22 which surround region 50. In any case, the design of region 50 ensures that the aerodynamic force exerted by the external atmosphere on cover 22, when missile 10 is in flight breaks hinge 26 only at region 50. The sequence of events which lead to this breakage are illustrated in FIGS. 4*a-e*.

It will be appreciated that this breakable hinge configuration can also be applied to an integral non-rotating hinge 26 in which case stoppage element 44 is not necessary.

While reducing the present invention to practice, however, it was discovered that the above described hinge detachment configurations, although functional, suffer from inherent limitations which can lead to unwanted detachment. For example, the use of these configurations fails to provide an exact angle at which cover 22 totally disconnects from missile 10. Precision in controlling this angle, however, is usually of great importance, because uncontrolled jettisoning may result in cover 22 striking and thereby destroying missile 10. In the case of the weakened hinge, in particular, it is a practical impossibility to predict, in an exact manner, the hinge behavior under aerodynamic forces characterizing supersonic speeds. In the case of the ball and socket hinge, such behavior is also somewhat unpredictable because while the aerodynamic forces increase and the cover opens, the area of contact within the hinge arrangement (i.e., the contact between ball and socket surfaces) decreases.

Thus, according to another and presently preferred embodiment of the present invention, and as specifically shown in FIG. 5, hinge 26 includes a shearable pin 52. According to this configuration, hinge 26 rotates to a stop against stoppage element 44, following which a force exerted on cover 22, breaks shearable pin 52 to thereby detach region 28 of cover 22 from region 30 of aerodynamic body 12 and thereby disconnect cover 22 from missile 10.

The above-mentioned force may be primarily an aerodynamic force applied by the external atmosphere when missile 10 is in flight, particularly at high speeds. Alternatively or additionally, the force may be delivered to cover 22 by releasing mechanism 38 (see FIGS. 2, 6).

Figure 6:
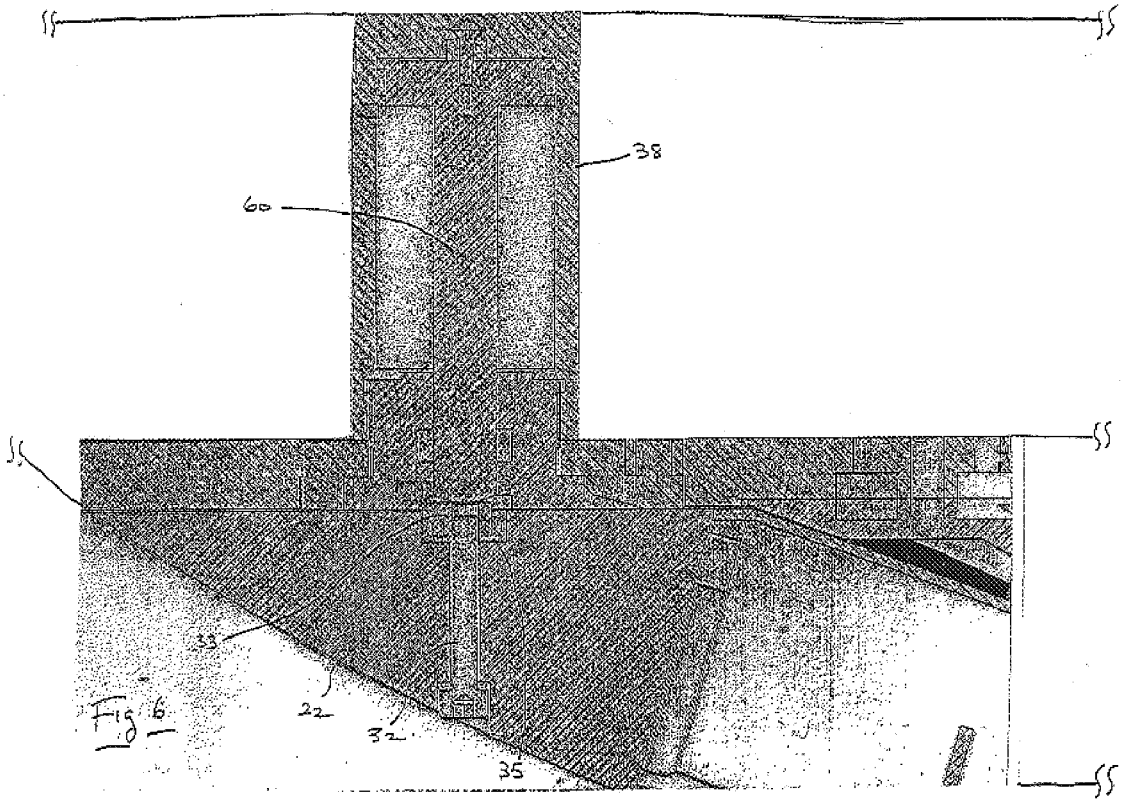
FIG. 6 is a detailed cross sectional view of the releasing mechanism according to the present invention.

As already mentioned hereinabove, and as shown in FIG. 2, aerodynamic body 12 includes a releasing mechanism 38 which serves to unsecure element 32 from breakable (or releasable) element 33. Such unsecuring can be achieved via any one of several dedicated mechanism and configurations. For example, and as shown in FIG. 6, mechanism 38 includes a hydraulically, mechanically or pneumatically driven piston 60, which when actuated, exerts a force of a predetermined magnitude on top of breakable element 33 to which securing element 32 is secured. This force breaks element 33, thus releasing or unsecuring securing element 32.

Cover 22 is designed to substantially reduce the drag force acting upon missile 10 when cover 22 is secured thereto. Nonetheless, the aerodynamic force exerted by the external atmosphere on cover 22 of missile 10 is enormous when missile 10 achieves high supersonic speeds such that unsecuring securing element 32 per se is not necessarily sufficient for detaching cover 22. Therefore, according to a preferred embodiment of the present invention, release mechanism 38 further serves to forcibly separate end 34 of cover 22 from region 36 of aerodynamic body 12 when missile 10 is in flight and thus under aerodynamic forces exerted by external atmosphere. This separation can be forcibly effected, for example, by piston 60 of the above described configuration of mechanism 38 following unsecuring of element 32.

In a preferred embodiment, releasing mechanism 38 is designed to first act against securing element 32 to unsecure end 34 of the cover 22 from region 36 of aerodynamic body 12, and only subsequently to act against the aerodynamic force force and thereby detach end 34 of cover 22 from aerodynamic body 12. By acting against the resistances (strength of breaking element 33 and resistance due to aerodynamic force) in sequentially, rather than in parallel, the required force generated by releasing mechanism 38 and exerted by piston 60 is significantly reduced.

One presently preferred embodiment for accomplishing this is shown by way of example in FIG. 6, wherein breakable element 33 is separated from cover 22 by air gap 35. When piston 60 exerts pressure on the top of breakable element 33, air channel 35 provides space for breakable element 33 to give way, without forcing securing element 32 (or any other inner working) to distend beyond the form of aerodynamic body 12, such that no aerodynamic force needs to be overcome at this stage. Subsequently, as securing element 32 is unsecured, and piston 60 forces securing element 32 out beyond the form of aerodynamic body 12, only the magnitude of the aerodynamic force needs to be overcome.

In a preferred embodiment, releasing mechanism 38 is actuated by a high-pressure gas reservoir as a source of energy for a force acting upon the releasable element.

In another preferred embodiment, releasing mechanism 38 is actuated by a pyroelectric element as a source of energy for a force acting upon the releasable element.

Figure 7:
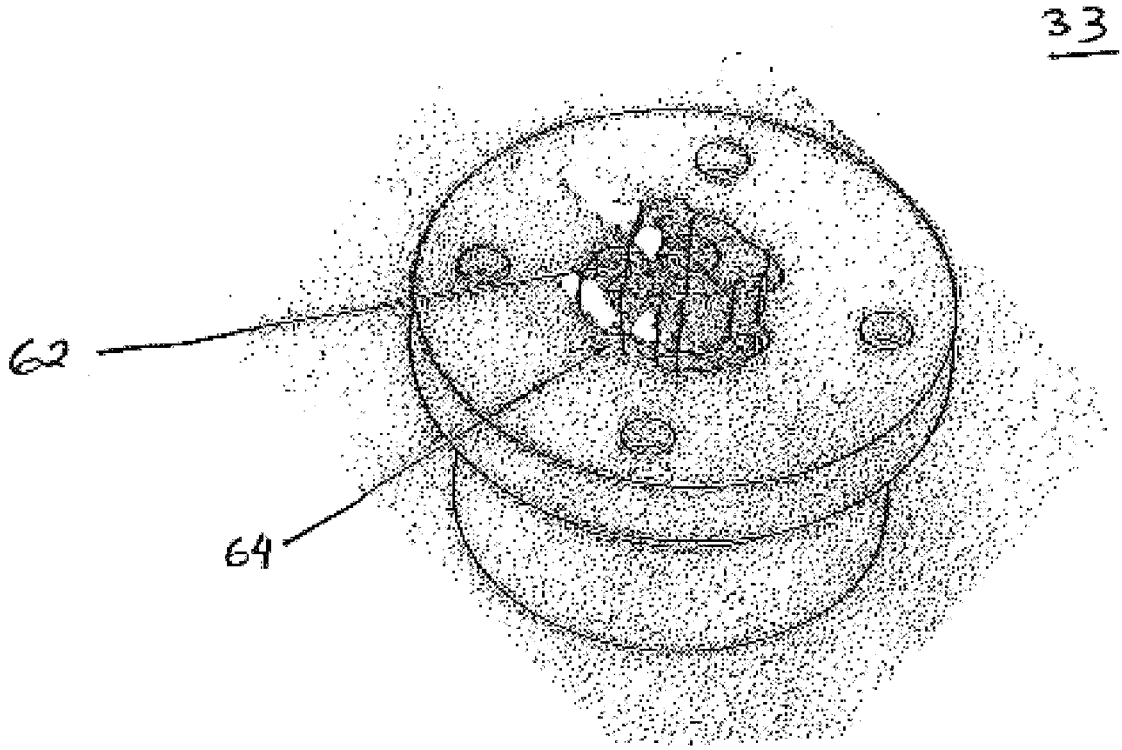
FIG. 7 is a perspective view of a breakable element utilized for securing the securing element according to the teachings of the present invention.
Figure 1:
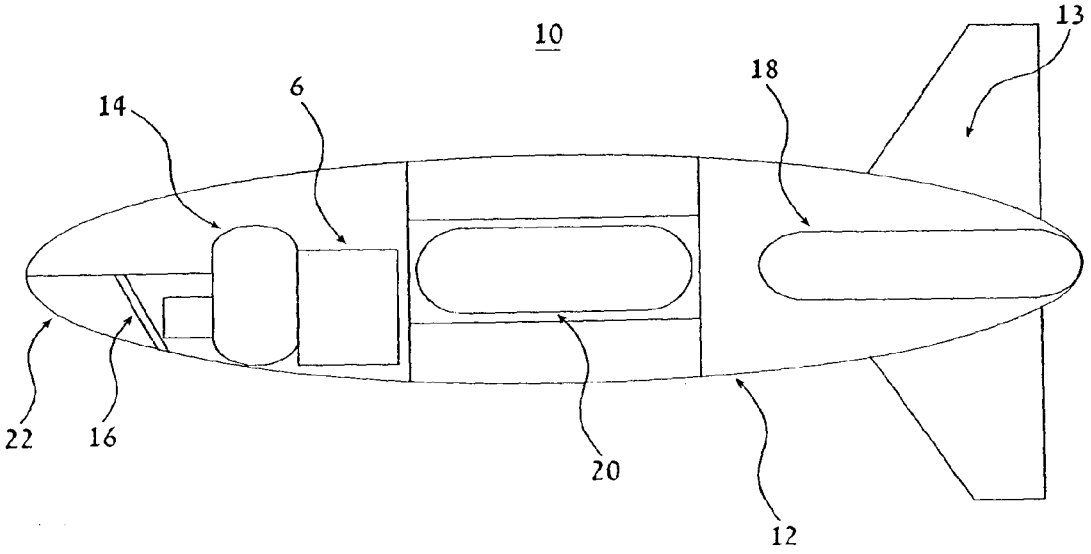
Figure 2:
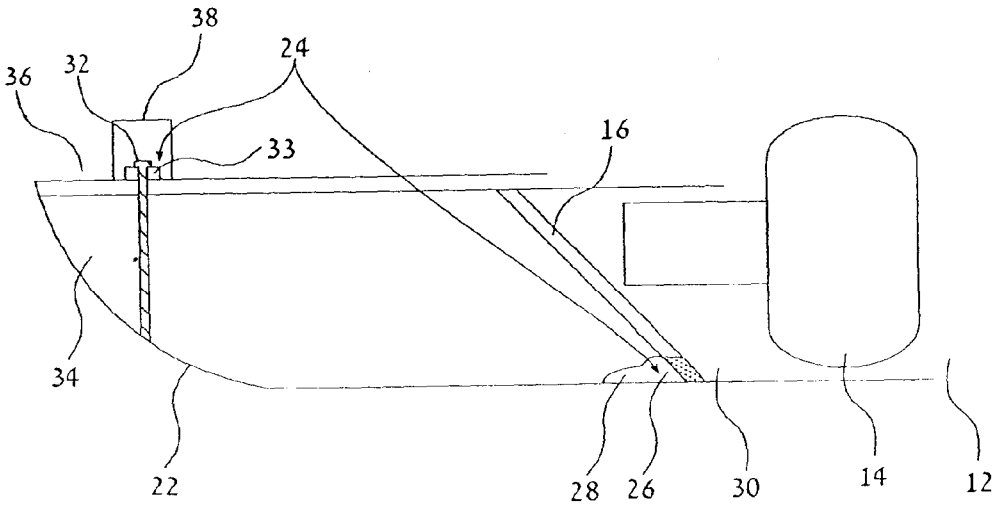
Figure 3:
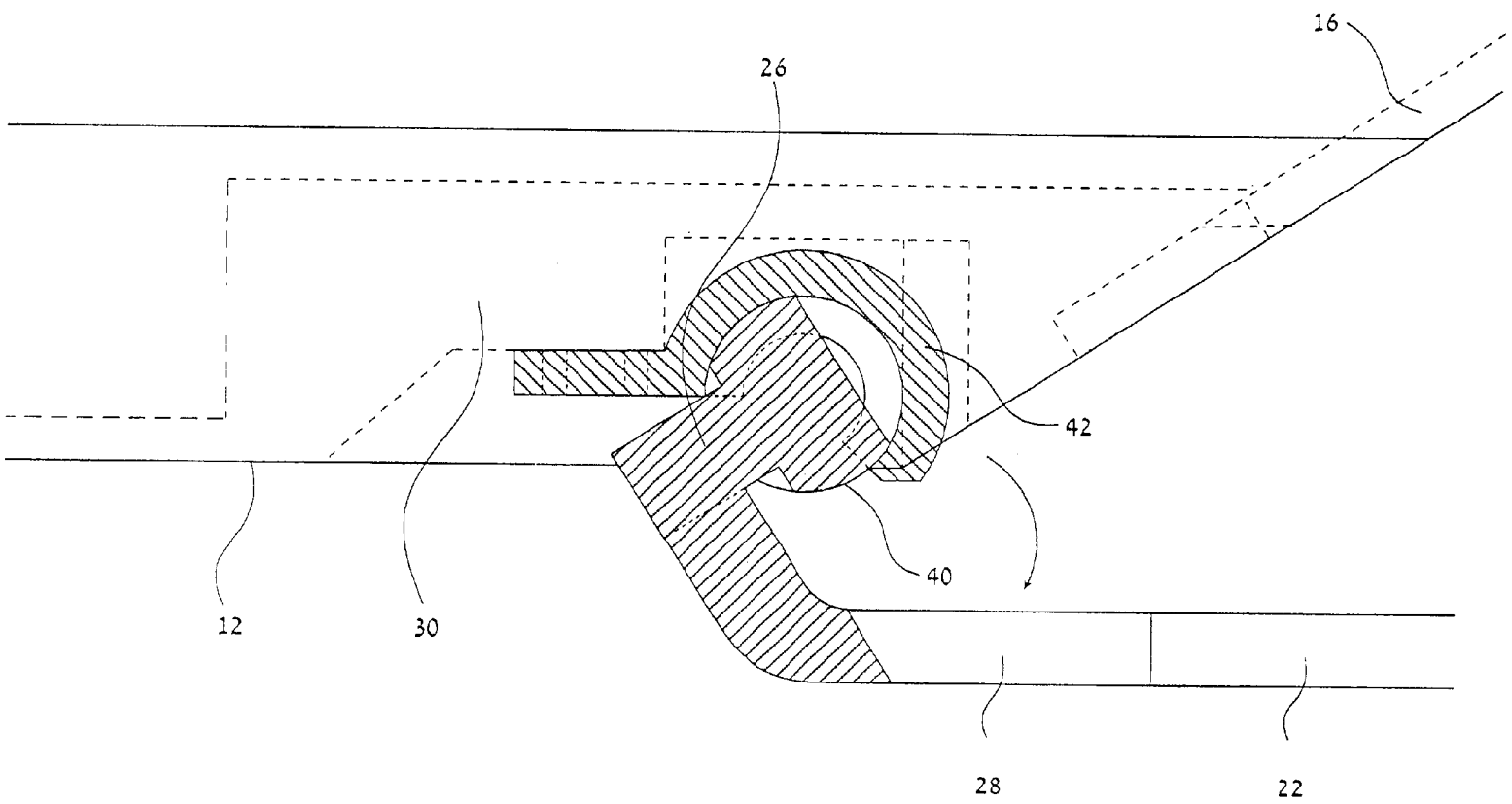
Figure 4A:
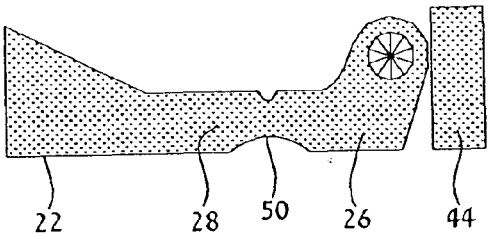
Figure 4B:
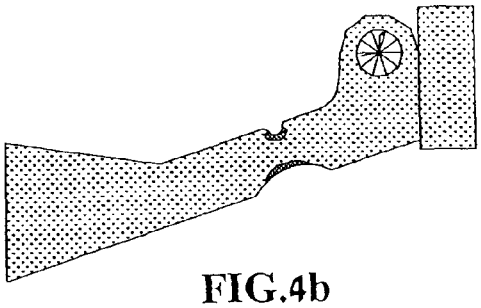
Figure 4C:
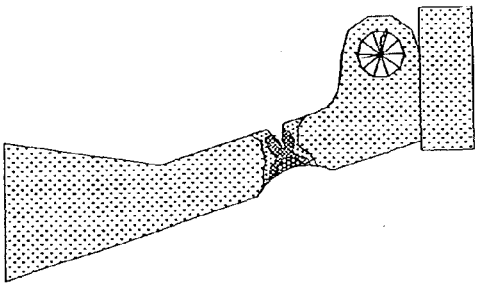
Figure 4D:
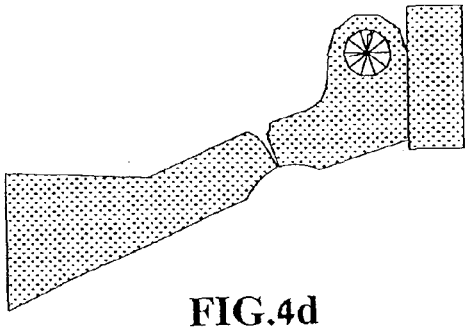
Figure 4C:
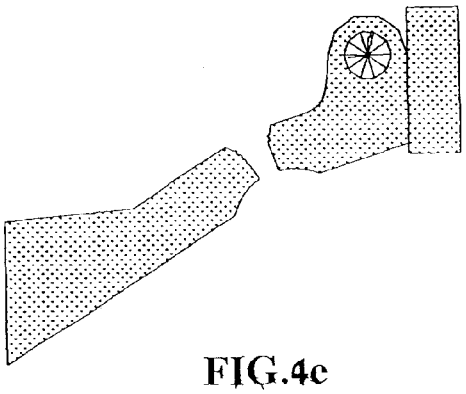
Figure 5:
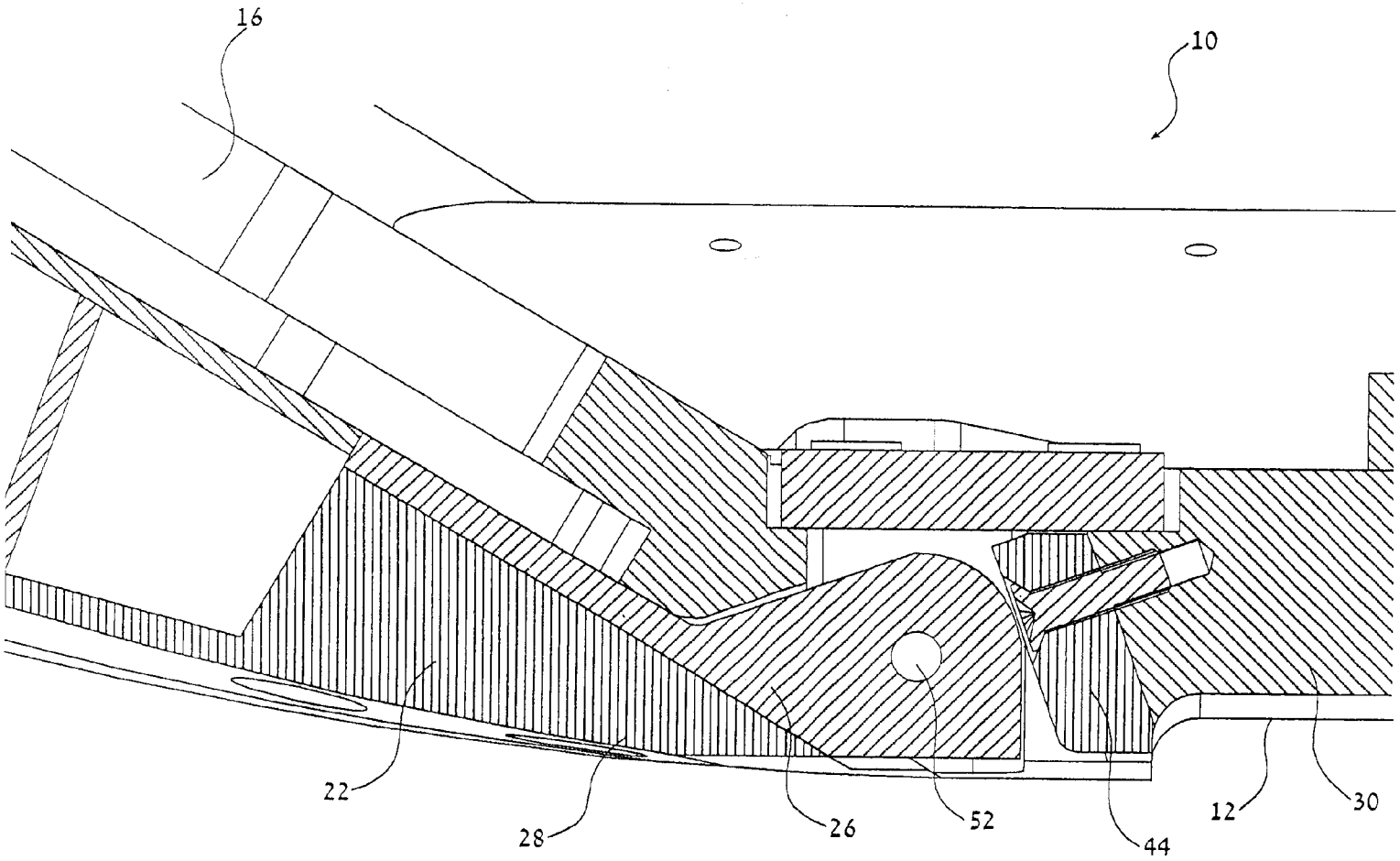
Figure 6:
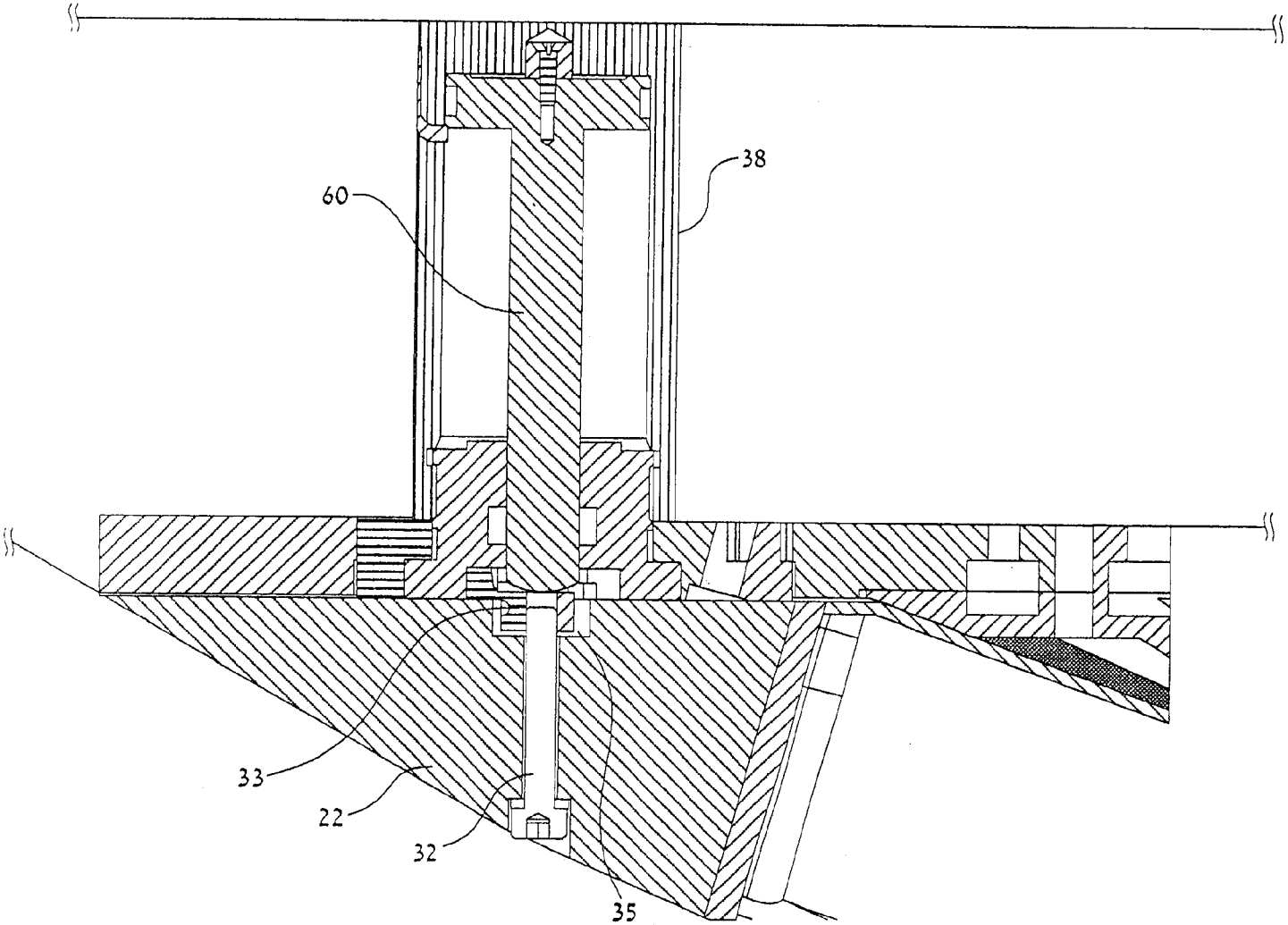
Figure 7:
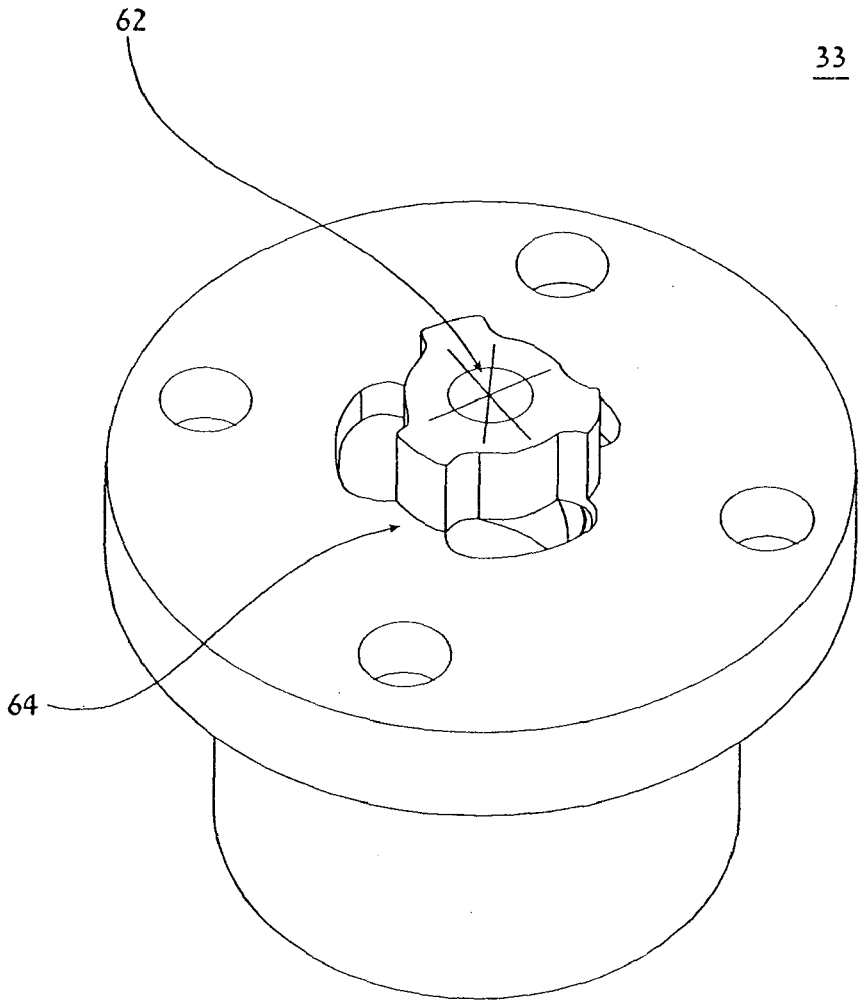

Several configurations of breakable element 33 can be realized by the present invention. For example, according to a preferred embodiment of the present invention and as specifically shown in FIG. 7, breakable element 33 includes a first region 62 for securing element 32, and a second region 64 which is attached to region 62 in a manner which allows region 62 to break off from region 64 when a predetermined amount of pressure is applied to region 62. A breakable configuration attaching regions 62 and 64 can be provided via the use of structural weakening, such as holes, or by using weaker material at the region of attachment.

According to the present invention, cover 22, releasable securing assembly 24 and releasing mechanism 38 are designed such that cover 22 can be jettisoned away from the missile in a manner which avoids collision therewith. In addition, missile 10 is designed such that following jettisoning of cover 22, the aerodynamic properties and weight distribution of missile 10 are not substantially affected.

Thus, the present invention provides a jettisonable cover which can be utilized to shield a window or dome of an electro-optical detection system from heat generated as a result of friction with the external atmosphere.

According to another preferred embodiment of the present invention cover 22 can also serve as a radar ghost when jettisoned.

Thus, according to this embodiment of the present invention, cover 22 preferably includes radar reflective regions. It will be appreciated that such radar reflective regions are preferably provided on an inside surface of cover 22 such that these regions are concealed from radar radiation when cover 22 is attached to missile 10, and exposed to radar radiation only after cover 22 has jettisoned.

It will further be appreciated that cover 22 can also be utilized as a radar ghost in subsonic or supersonic missiles which do not carry an electro-optical detection system or regardless of such systems.

Thus, according to another aspect of the present invention, cover 22 can be utilized solely as a radar reflective element and as such can be configured of any shape, size or number and can be attached to any region of a missile. Preferably, in such cases, cover 22 is attached to a rearward section of a missile such that when jettisoned, the likelihood of collision between cover 22 and the missile is minimized. Although the various jettisonable configurations of the cover described above provides several unique advantages when incorporated into a high speed missile, it will be appreciated that other configurations can also be realized by the present invention.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications cited herein are incorporated by reference in their entirety. Citation or identification of any reference in this application shall not be construed as an admission that such reference is available as prior art to the present invention.

What is claimed is:

1. An airborne platform comprising:

(a) an aerodynamic body;

(b) a protected element within said aerodynamic body;

(c) a cover, reversibly secured to said aerodynamic body, for protecting said protected element from an external atmosphere;

(d) a releasing mechanism for at least partially detaching said cover from said aerodynamic body, and (e) a securing assembly for securing said cover to said aerodynamic body, said securing assembly including a hinge for connecting a first end of said cover to a first region of said aerodynamic body, and a releasable element securing a second end of said cover to a second region of said aerodynamic body, said hinge being configured such that when said second end of said cover separates from said second region of said aerodynamic body when the airborne platform is in flight, a force exerted on said cover detaches said hinge, thereby removing said cover from said aerodynamic body, and wherein said hinge includes an asymmetric ball element disposed in a socket.

2. The airborne platform of claim 1, said hinge being configured such that said force exerted on said hinge rotates said cover prior to detaching said hinge.

3. The airborne platform of claim 1, wherein said hinge is adapted such that when said second end of said cover separates from said second region by a predetermined angle, said asymmetric ball element is rotated until disengagement from said socket, thus effecting spontaneous disassembly of said ball element.

4. The airborne platform of claim 1, wherein said releasable element is urged by a piston.

5. The airborne platform of claim 1, wherein said cover is operative to Jettison away from said platform when released.

6. An airborne platform comprising:

(a) an aerodynamic body;

(b) a protected element within said aerodynamic body;

(c) a cover, reversibly secured to said aerodynamic body, for protecting said protected element from an external atmosphere;

(d) a releasing mechanism for at least partially detaching said cover from said aerodynamic body, and (e) a securing assembly for securing said cover to said aerodynamic body, said securing assembly including a hinge for connecting a first end of said cover to a first region of said aerodynamic body, and a releasable element securing a second end of said cover to a second region of said aerodynamic body, said hinge being configured such that when said second end of said cover separates from said second region of said aerodynamic body when the airborne platform is in flight, a force exerted on said cover detaches said hinge, thereby removing said cover from said aerodynamic body, and wherein said hinge includes a stoppage element, said stoppage element serving for limiting an angular movement of said hinge such that when said second end of said cover separates from said second region by a predetermined parameter, a force exerted on said cover acts to effect a disengagement of said cover in a predetermined location.

7. The airborne platform of claim 6, wherein said disengagement includes a breaking of said cover.

8. The airborne platform of claim 6, wherein said hinge further includes a shearable pin.

9. The airborne platform of claim 8, wherein force exerted on said cover releases said shearable pin.

10. The airborne platform of claim 8, wherein force exerted on said cover breaks said shearable pin so as to release said cover from said aerodynamic body.

11. The airborne platform of claim 8, wherein said cover is operative to jettison away from said platform when released.

12. An airborne platform comprising:

(a) an aerodynamic body;

(b) a protected element within said aerodynamic body;

(c) a cover, reversibly secured to said aerodynamic body, for protecting said protected element from an external atmospheric atmosphere;

(d) a securing assembly for securing said cover to said aerodynamic body, said securing assembly including a hinge for connecting a first end of said cover to a first region of said aerodynamic body, and a releasable element securing a second end of said cover to a second region of said aerodynamic body, and (e) a releasing mechanism for at least partially detaching said cover from said aerodynamic body, said hinge being configured such that when said second end of said cover separates from said second region of said aerodynamic body when the airborne platform is in flight within said atmosphere, a force exerted on said cover detaches said hinge, thereby removing said cover from said aerodynamic body, and wherein said releasing mechanism is designed and configured to be substantially isolated from an aerodynamic force exerted by said external atmospheric atmosphere while urging said releasable element to unsecure said second end of said cover, and only subsequently to act against said aerodynamic force, so as to at least partially detach said second end of said cover from said aerodynamic body.

13. The airborne platform of claim 12, wherein said releasing mechanism includes a piston.

14. The airborne platform of claim 13, said piston being operative to urge said releasable element to unsecure said second end of said cover.

15. The airborne platform of claim 14, said piston being further operative to separate said second end of said cover from said second region of said aerodynamic body.

16. The airborne platform of claim 12, wherein said releasable element includes an air gap for physically isolating said releasing mechanism from said aerodynamic force exerted by said atmosphere while said releasing mechanism unsecures said second end of said cover.

17. The airborne platform of claim 12, wherein said releasable element includes a breakable element designed to be broken by said releasing mechanism, and an air gap disposed between said breakable element and said cover, for isolating said releasing mechanism from said aerodynamic force exerted by said atmosphere while said releasing mechanism unsecures said second end of said cover.

18. The airborne platform claim 12, wherein of said releasing mechanism is powered by a high pressure gas reservoir.

19. The airborne platform of claim 12, wherein said releasing mechanism is powered by a pyroelectric element.

20. The airborne platform of claim 12, further comprising:

(f) an electro-optical detection system disposed within said aerodynamic body, said electro-optical detection system having an optical window, said cover for protecting said optical window from said atmosphere.

21. The airborne platform of claim 12, wherein said cover is operative to jettison away from the platform upon release of said cover.

22. The airborne platform of claim 12, wherein said cover includes at least one radar reflective region, such that the jettisoning of said cover from the airborne platform generates a radar ghost.

* * * * *

UNITED STATES PATENT AND TRADEMARK OFFICE

CERTIFICATE OF CORRECTION

PATENT NO. : 6,679,453 B2
DATED : January 20, 2004
INVENTOR(S) : Steiner

It is certified that error appears in the above-identified patent and that said Letters Patent is hereby corrected as shown below:

Drawings,
Replace 6 drawings sheets of Replacement Formal Drawings consisting of Figures 1-7 as attached.

Signed and Sealed this

Sixth Day of April, 2004

JON W. DUDAS
*Acting Director of the United States Patent and Trademark Office*